US010854406B2

(12) United States Patent
Bobert

(10) Patent No.: US 10,854,406 B2
(45) Date of Patent: Dec. 1, 2020

(54) RELAY

(71) Applicant: EPCOS AG, Munich (DE)

(72) Inventor: Peter Bobert, Falkensee (DE)

(73) Assignee: EPCOS AG, Munich (DE)

( * ) Notice: Subject to any disclaimer, the term of this patent is extended or adjusted under 35 U.S.C. 154(b) by 231 days.

(21) Appl. No.: 16/069,740

(22) PCT Filed: Jan. 30, 2017

(86) PCT No.: PCT/EP2017/051945
§ 371 (c)(1),
(2) Date: Jul. 12, 2018

(87) PCT Pub. No.: WO2017/129823
PCT Pub. Date: Aug. 3, 2017

(65) Prior Publication Data

US 2019/0019643 A1 Jan. 17, 2019

(30) Foreign Application Priority Data

Jan. 29, 2016 (DE) ..... 10 2016 101 615
Apr. 18, 2016 (DE) ..... 10 2016 107 127

(51) Int. Cl.

| | |
|---|---|
| ***H01H 9/00*** | (2006.01) |
| ***H01H 47/00*** | (2006.01) |
| ***H01H 36/00*** | (2006.01) |
| ***H01H 51/06*** | (2006.01) |
| ***H01H 71/04*** | (2006.01) |
| *H01H 71/46* | (2006.01) |

(52) U.S. Cl.
CPC ..... *H01H 47/002* (2013.01); *H01H 36/0006* (2013.01); *H01H 36/0013* (2013.01); *H01H 51/065* (2013.01); *H01H 71/04* (2013.01); *H01H 71/46* (2013.01); *H01H 2071/048* (2013.01)

(58) Field of Classification Search
CPC .. H01H 1/0015; H01H 50/045; H01H 47/002; H01H 71/04; H01H 36/00; H01H 36/0013; H01H 51/065; G01R 31/327
USPC ..... 335/203
See application file for complete search history.

(56) References Cited

U.S. PATENT DOCUMENTS

| | | | | |
|---|---|---|---|---|
| 4,748,343 A * | 5/1988 | Engel | H01H 47/002 307/134 |
| 5,227,751 A * | 7/1993 | Shiroyama | F02N 15/066 335/126 |
| 5,892,194 A * | 4/1999 | Uotome | H01H 1/34 218/68 |
| 8,130,064 B2 * | 3/2012 | Moeller | H01H 1/2083 335/128 |

(Continued)

FOREIGN PATENT DOCUMENTS

| | | |
|---|---|---|
| CN | 87203659 U | 5/1988 |
| CN | 1402878 A | 3/2003 |

(Continued)

*Primary Examiner* — Shawki S Ismail
*Assistant Examiner* — Lisa N Homza
(74) *Attorney, Agent, or Firm* — Slater Matsil, LLP

(57) ABSTRACT

A relay is disclosed. In an embodiment a relay includes a magnet armature including a magnetic core and a permanent magnet secured to the magnet armature for identifying a position of the magnet armature.

18 Claims, 1 Drawing Sheet

(56) References Cited

U.S. PATENT DOCUMENTS 8,179,217 B2 * 5/2012 Kawaguchi ..... H01F 7/1615 335/124
8,289,026 B2 10/2012 Keil et al.
8,803,642 B2 8/2014 Imamura et al.
9,159,512 B2 * 10/2015 Kodama ..... H01H 47/002
10,115,512 B2 * 10/2018 Koch ..... G01S 17/06
2009/0322453 A1 * 12/2009 Kawaguchi ..... H01F 7/1615 335/81
2010/0060287 A1 3/2010 Keil et al.
2010/0264764 A1 * 10/2010 Usami ..... H01H 51/065 310/71
2011/0001589 A1 * 1/2011 Usami ..... H01H 50/14 335/196
2011/0057751 A1 * 3/2011 Feil ..... H01H 55/00 335/205
2011/0140813 A1 * 6/2011 Suzuki ..... F02N 11/087 335/156
2011/0279202 A1 * 11/2011 Ramezanian ..... H01H 1/06 335/196
2012/0162847 A1 * 6/2012 Suzuki ..... F02N 11/087 361/206
2013/0342292 A1 * 12/2013 Choi ..... H01H 50/00 335/192
2014/0002092 A1 * 1/2014 Kodama ..... H01H 1/0015 324/418
2016/0314925 A1 * 10/2016 Birner ..... H01H 51/065
2017/0069450 A1 * 3/2017 Birner ..... H01H 50/12
2018/0204698 A1 * 7/2018 Westebbe ..... H01H 50/44

FOREIGN PATENT DOCUMENTS

CN 103069531 A 4/2013
CN 103282994 A 9/2013
CN 204011293 U 12/2014
CN 105244204 A 1/2016
DE 102007002176 A1 7/2008
GB 2350724 A 12/2000
JP 2010010058 A 1/2010
WO 2012128038 A1 9/2012

* cited by examiner

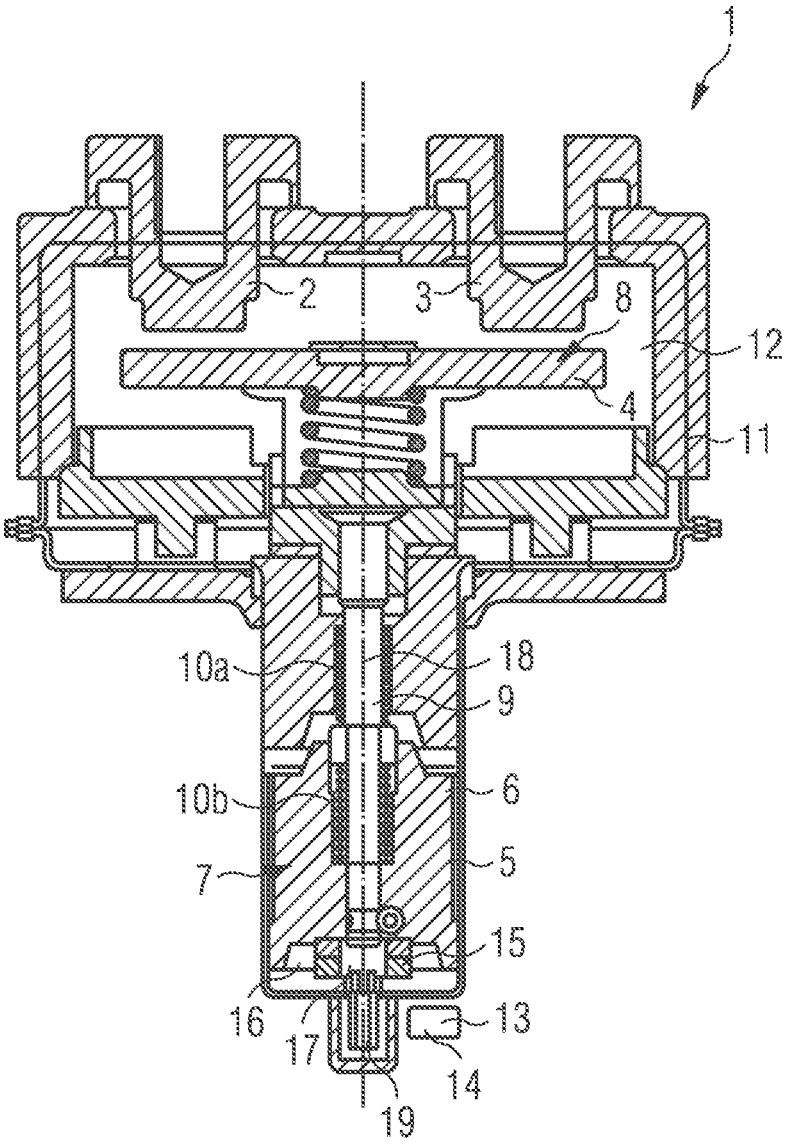
1
2
3
8
12
4
11
10a
18
9
10b
6
7
5
15
16
17
13
14
19

RELAY

This patent application is a national phase filing under section 371 of PCT/EP2017/051945, filed Jan. 30, 2017, which claims the priority of German patent application 10 2016 101 615.2, filed Jan. 29, 2016 and German patent application 10 2016 107 127.7, filed Apr. 18, 2016, each of which is incorporated herein by reference in its entirety.

TECHNICAL FIELD

The present invention relates to a relay. Relay is used to refer to an electromagnetically active switch that is operated by an electric current and has at least two switch positions.

BACKGROUND

The relay is used, for example, in circuits with high voltages. The relay can be formed as a gas-filled contactor. For reasons of safety, it can be expedient to identify the switching position of the relay contacts. This makes it possible, for example, in the event of a sticking contact, to react to the abnormal response with suitable measures.

SUMMARY OF THE INVENTION

Embodiments provide a relay having improved properties.

According to a first embodiment of the present invention, a relay is specified. The relay has a magnet armature comprising a magnetic core. A permanent magnet is secured to the magnet armature for identifying the position of the magnet armature.

The permanent magnet generates a magnetic field, which can be detected by a magnetic sensor. The magnetic sensor can detect the position of the permanent magnet and, as a result, the position of the magnet armature. In particular, the magnetic sensor can identify whether contacts of the relay are open.

In one embodiment, the relay has a housing. The housing can be closed, in particular closed in a hermetically impermeable manner. The magnet armature and the permanent magnet are arranged, for example, in the housing. In particular, the contacts of the relay can also be arranged in the housing. The housing can be filled with a gas, in particular with a protective gas. The gas is intended to prevent the production of arcs. Arcs can be produced when the contacts are opened and can lead to damage of the contacts. This can lead, in particular, to the contacts remaining "stuck" to one another and no longer being able to separate.

In one embodiment, the magnetic sensor is arranged outside of the housing. This makes it possible to identify the switching position through the wall of the housing without cable guides through the housing. Furthermore, simple retrofitting of the relay with a magnetic sensor is possible as a result, provided that the relay is already furnished with the permanent magnet.

When the relay is actuated, a movement of the magnetic core and hence of the entire magnet armature is generated by a flow of current in a coil. Said movement is, for example, an axial movement. The change in position of the magnet armature leads to a closure of contacts of the relay. For example, in a first position of the magnet armature, the relay is situated in a rest state in which the contacts are open. In a second position of the magnet armature, the relay is situated in an active state in which the contacts are closed.

The relay can have at least one stationary contact. By way of example, the relay has two stationary contacts. The relay can also have at least one movable contact. The movable contact is formed, for example, as part of the magnet armature. By way of example, the movable contact is formed in the shape of a plate. The movable contact can be located at an axial end of the magnet armature. The movable contact forms, for example, an end side of the magnet armature. The magnetic core forms, for example, an opposite axial end of the magnet armature.

In one embodiment, the magnetic sensor is a switch, which is actuated by the magnetic field. In particular, it may be a magnetic sensor that does not require an additional voltage supply. By way of example, the magnetic sensor is a reed switch or reed sensor. Alternatively, said sensor can also be a Hall sensor, for example.

The magnetic sensor, for example, a reed switch, can be formed as an on-switch, a normally closed contact or a changeover switch. An on-switch is open in its rest state and is closed owing to the effect of a magnetic field. A normally closed contact is closed in its rest state and is opened owing to the effect of a magnetic field. A changeover switch has a normally closed contact and a working contact, wherein the normally closed contact is closed in the rest state of the changeover switch. The effect of a magnetic field opens the normally closed contact and closes the working contact.

In one embodiment, the relay has a magnetic sensor of this kind. However, it is also possible for the relay to be provided with the permanent magnet and not to be retrofitted with a magnetic sensor until later.

In one embodiment, the permanent magnet is secured to the magnetic core. The permanent magnet is arranged, for example, at a first axial end of the magnet armature. In particular, the permanent magnet can be arranged at an end side of the magnet armature.

In one embodiment, the magnet armature has a recess. The permanent magnet can be arranged at least partly in the recess. The recess is located, for example, at an end side of the magnet armature.

In one embodiment, the permanent magnet is formed symmetrically with respect to a longitudinal axis of the relay. This makes it possible to position the magnetic sensor in a particularly simple manner, in particular when the permanent magnet is not visible during the positioning of the magnetic sensor. The permanent magnet is formed, for example, as a disk magnet.

In one embodiment, the permanent magnet has an opening or recess. A component of the relay can be at least partly held in the opening or recess, at least in certain positions of the magnet armature. Furthermore, the opening or recess can save weight, which is advantageous, in particular, for a movable part of the relay. The permanent magnet is formed, for example, as a ring magnet.

A plurality of embodiments of the invention is described in the present disclosure. All properties disclosed with regard to an embodiment are also correspondingly disclosed with regard to other embodiments, even if the respective property is not explicitly mentioned in the context of another embodiment.

BRIEF DESCRIPTION OF THE DRAWINGS

The subjects described here are explained in more detail in the following text with reference to a schematic exemplary embodiment.

In the drawing:

FIG. 1 shows a sectional view of an embodiment of a relay.

DETAILED DESCRIPTION OF ILLUSTRATIVE EMBODIMENTS

FIG. 1 shows a relay 1, which is used, for example, for switching high electric currents and/or high voltages.

The relay 1 has two stationary contacts 2, 3 and a movable contact 4. The movable contact 4 is formed as a contact plate.

FIG. 1 shows the relay 1 in a rest state. The movable contact 4 is spaced apart from the stationary contacts 2, 3 so that the contacts 2, 3, 4 are galvanically isolated from one another. The stationary contacts 2, 3, together with the movable contact 4, form the relay contacts. The relay contacts can also be formed in an alternative manner. For example, just one of the relay contacts can be formed as stationary.

The relay 1 has a movable magnet armature 5. The magnet armature 5 has a magnetic core 6. The magnetic core 6 comprises a ferromagnetic material. The magnet armature 5 has a first axial end 7 and an opposite second axial end 8. The magnetic core 6 forms the first axial end 7 of the magnet armature 5. The movable contact 4 forms the second axial end 8 of the magnet armature 5.

The magnet armature 5 has a shaft 9, which is guided through the magnetic core 6 and is fixedly connected to the magnetic core 6. The magnetic core 6 is surrounded by a coil (not depicted).

A flow of current in the coil generates a movement of the magnetic core 6 and hence of the entire magnet armature 5 in the axial direction until the movable contact 4 contacts the stationary contacts 2, 3. The magnet armature 5 thus moves from a first position into a second position. The relay 1 is then situated in the active state so that the contacts 2, 3, 4 are galvanically connected to one another. In another embodiment, the magnet armature 5 can also carry out a rotational movement. The magnet armature 5 can be formed, in particular, as a tie rod or hinged armature.

If the flow of current in the coil is interrupted, the magnet armature 5 is moved back into its first position by springs boa, bob. The relay 1 is then situated in the rest state in which the contacts 2, 3, 4 are open.

When the contacts 2, 3, 4 are opened, an arc, which can damage the contact faces, can be produced. This can lead to the contacts 2, 3, 4 remaining "stuck" to one another and no longer being separated from one another. In order to prevent the production of such arcs, the contacts 2, 3, 4 are arranged in a hermetically sealed housing 11, which is filled with a gas 12. The housing 11 surrounds the magnet armature 5 and the contacts 2, 3, 4 completely. The component part is consequently formed as a gas-filled relay 1 or gas-filled contactor.

For reasons of safety, the relay 1 has an apparatus for identifying the position of the magnet armature 5 and, as a result, for identifying the position of the movable contact 4. This is expedient, in particular, when the relay 1 is used in circuits with life-endangering voltages. This makes it possible, for example, in the event of a sticking contact, to react to this abnormal response with suitable measures.

In particular, the relay 1 has a magnetic sensor 13, which is actuated by means of a magnetic field. The magnetic sensor 13 is arranged outside of the housing 11. The magnetic sensor 13 is, for example, a switch 14, in particular a reed switch. A reed switch has one or more movable switching tongues, which move toward one another or toward a non-movable contact under the effect of a magnetic field. The switching tongues and contacts are arranged, for example, in a glass tube. Alternatively, said sensor may also be a Hall sensor, for example.

The switch 14 is actuated by a permanent magnet 15. The permanent magnet 15 is located in the interior of the hermetically sealed housing 11. The permanent magnet 15 is fixedly connected to the magnet armature 5. In particular, the permanent magnet 15 can be secured directly to the magnetic core 6. The permanent magnet 15 is substantially smaller than the magnetic core 6. The permanent magnet 15 comprises a different material than the magnetic core 6. The permanent magnet 15 is arranged at an end side of the magnet armature 5. For example, the magnet armature 5 and, in particular, the magnetic core 6, has a recess 16 in which the permanent magnet 15 is at least partly arranged.

The permanent magnet 15 is arranged, for example, in such a way that the north-south direction thereof runs in the axial direction of the magnet armature 5. The permanent magnet 15 can also be arranged in such a way that the north-south direction thereof runs in the radial direction of the magnet armature 5. The arrangement of the magnetic sensor 13 depends on the arrangement of the permanent magnet 15. The permanent magnet 15 is preferably formed and arranged symmetrically with respect to a rotation about a longitudinal axis 18 of the relay 1. This makes it possible to position the magnetic sensor 13 as desired with respect to the longitudinal axis. In particular, the positioning of the magnetic sensor 13 in the closed state of the housing 11 is made easier, that is to say when the permanent magnet 15 is no longer visible from the outside.

The permanent magnet 15 has, for example, an opening 17. The permanent magnet 15 is formed, for example, as a ring magnet. Further components of the relay 1 project, for example, into the opening 17. In particular, the relay 1 can have an exhaust tube 19, which extends at least intermittently into the opening 17 of the permanent magnet 15 in the first position of the permanent magnet 15. The exhaust pump 19 serves to evacuate the gas and to subsequently fill the relay 1 with the gas 12, in particular a protective gas. After the filling with the gas 12, the housing 11 is closed in impermeable fashion, for example, by sealing off the exhaust pump 19.

When the magnet armature 5 moves, the permanent magnet 15 is conjointly moved therewith. If the magnet armature 5 moves from its second position into its first position, the switch 14 is closed, for example. Here, the magnetic field of the permanent magnet 15 acts, for example, on a movable switching tongue of the switch 14. The switch 14 is consequently closed when the relay 1 is situated in the rest state and the contacts 2, 3, 4 are open. This makes it possible to identify "sticking" contacts 2, 3, 4, since the switch 14 is not closed in this case. Alternatively, the switch 14 can also be arranged and formed in such a way that the switch 14 is open in the first position of the magnet armature 5.

Alternatively, the switch 14 can also be formed as a changeover switch. A working contact of the switch 14 is closed in the rest state of the relay 1, for example. If the magnet armature 5 moves from its first position into its second position in which the relay contacts are closed, the working contact of the switch 14 is opened and the normally closed contact of the switch 14 is closed.

The permanent magnet 15 and the magnetic sensor 13 or switch 14 are arranged with respect to one another in such a way and the permanent magnet 15 is so powerful that the permanent magnet 15 can activate the magnetic sensor 13 in a rest position through the wall of the housing 11. Furthermore, the magnetic sensor 13 and the permanent magnet 15 have to be arranged in such a way that the functioning thereof is not adversely affected by the electromagnetic field of the coil and of the magnetic core 6. The magnetic sensor 13 is arranged, for example, on a bottom side of the housing 11, in particular at least partly below the magnet armature 5.

Cable guides through the housing 11 are therefore not required for identifying the switching position of the movable contact 4. Furthermore, when the magnet armature 5 is furnished with a permanent magnet 15, simple retrofitting with a magnetic sensor 13, in particular with a switch 14 that is to be actuated magnetically, is possible.

The magnetic sensor 13 is fixedly connected, for example, to the housing 11. For example, the magnetic sensor 13 can be adhesively bonded to the housing 11 or can be fixed in some other way to the housing 11. Alternatively, the magnetic sensor 13 is connected to an additional carrier, which ensures locationally fixed positioning of the magnetic sensor 13 with respect to the housing 11.

The invention claimed is:

1. A relay comprising:

a magnet armature comprising a magnetic core;

a permanent magnet secured to the magnet armature for identifying a position of the magnet armature, wherein the permanent magnet is a ring magnet with an opening;

a magnetic sensor configured to detect a magnetic field of the permanent magnet;

a hermetically sealed housing, wherein the magnet armature and the permanent magnet are arranged inside the housing, wherein the magnetic sensor is arranged outside of the housing, wherein the magnetic sensor is fixedly connected to the housing, and wherein the housing is configured to be filled with a gas; and an exhaust tube extending at least intermittently into the opening in a first position of the permanent magnet.

2. The relay according to claim 1, wherein the magnetic sensor comprises a switch.

3. The relay according to claim 2, wherein the switch comprises a reed switch.

4. The relay according to claim 2, further comprising a plurality of contacts, wherein the switch is closed when the contacts are open.

5. The relay according to claim 2, further comprising a plurality of contacts, wherein the switch is open when the contacts are closed.

6. The relay according to claim 1, wherein the magnetic sensor comprises a changeover switch.

7. The relay according to claim 1, wherein the permanent magnet is secured to the magnetic core.

8. The relay according to claim 1, wherein the permanent magnet is arranged at a first axial end of the magnet armature.

9. The relay according to claim 8, further comprising a movable contact, which forms a second axial end of the magnet armature, wherein the second axial end is opposite the first axial end.

10. The relay according to claim 1, wherein the magnet armature has a recess, and wherein the permanent magnet is arranged at least partly in the recess.

11. The relay according to claim 1, wherein the permanent magnet is formed symmetrically with respect to a longitudinal axis of the relay.

12. The relay according to claim 1, wherein the permanent magnet is formed as a disk magnet.

13. The relay according to claim 1, wherein the exhaust tube comprises an exhaust pump, and wherein the exhaust pump is configured to evacuate the gas from the housing.

14. The relay according to claim 1, wherein the gas is a protective gas.

15. The relay according to claim 1, wherein the relay is an electromagnetically active switch.

16. A relay comprising:

a hermetically sealed housing configured to be filled with a gas;

contacts located at a first side of the housing;

a magnet armature comprising a magnetic core and a permanent ring magnet with an opening secured to the magnet armature for identifying a position of the magnet armature, the magnet armature located at a second side of the housing;

a movable contact arranged at a second axial end of the magnet armature opposite to a first axial end where the permanent magnet is arranged, the movable contact configured to contact the contacts in an active state and galvanically isolate from the contacts in a rest state, wherein the housing surrounds the magnet armature and the contacts completely;

a magnetic sensor configured to detect a magnetic field of the permanent magnet, wherein the magnetic sensor is fixedly arranged outside the housing; and an exhaust tube extending at least intermittently into the opening in a first position of the permanent magnet, the exhaust tube connectable to a chamber configured to be filled with the gas inside the housing where the contacts and the movable contact are located.

17. The relay according to claim 16, wherein the relay is an electromagnetically active switch.

18. The relay according to claim 16, wherein the magnet armature is a tie rod or a hinged armature.

* * * * *